US006200176B1

(12) United States Patent
Bowers

(10) Patent No.: US 6,200,176 B1
(45) Date of Patent: Mar. 13, 2001

(54) MARINE JET DRIVE PUMP PRELOADER FOR REDUCING CAVITATION

(76) Inventor: Donald I. Bowers, 1353 Ashland Ave., Columbus, OH (US) 43212

( * ) Notice: Subject to any disclaimer, the term of this patent is extended or adjusted under 35 U.S.C. 154(b) by 0 days.

(21) Appl. No.: 09/116,997

(22) Filed: Jul. 17, 1998

(51) Int. Cl.[7] ..... B63H 11/103
(52) U.S. Cl. ..... 440/47
(58) Field of Search ..... 417/320; 60/221; 440/38, 47, 81, 73

(56) References Cited

U.S. PATENT DOCUMENTS 3,405,526 * 10/1968 Aschauer ..... 440/38
4,182,118 * 1/1980 Chronic ..... 60/221
4,902,254 * 2/1990 Chas ..... 440/38

FOREIGN PATENT DOCUMENTS

406247385 * 9/1994 (JP) ..... 440/47

* cited by examiner

*Primary Examiner*—Ed Swinehart
(74) *Attorney, Agent, or Firm*—Sherman & Shalloway

(57) ABSTRACT

This invention relates to marine jet drive systems and, more particularly to marine jet drive systems which include or are retrofitted with a preloader for reducing cavitation. The invention also relates to such a preloader which may be retrofitted to a standard marine jet drive system. The invention further relates to a method for reducing cavitation during operation of a marine jet drive system. The preloader comprises a water propelling device mounted on a shaft and rotatable within an intake housing of a marine jet drive unit ahead of and in axial alignment with the eye of the jet drive pump impeller whereby the water propelling device causes water to be drawn from the intake housing into the pump such that the pump impeller is preloaded with water across the eye of the impeller cavitation is reduced.

20 Claims, 3 Drawing Sheets

MARINE JET DRIVE PUMP PRELOADER FOR REDUCING CAVITATION

FIELD OF THE INVENTION

This invention relates to marine jet drive systems and, more particularly to marine jet drive systems which include or are retrofitted with a preloader for reducing cavitation. The invention also relates to such a preloader which may be retrofitted to a standard marine jet drive system. The invention further relates to a method for reducing cavitation during operation of a marine jet drive system.

BACKGROUND OF THE INVENTION

Marine jet drive systems for watercraft generally comprise a water conduit disposed toward the rear of the watercraft which conduit comprises an intake portion, a pump portion and a discharge portion. A pump impeller within the pump portion is generally driven by a shaft which extends from a prime mover through the intake portion to the pump portion. Water from under the watercraft enters the intake portion and passes to the pump portion. The water pump impeller in the pump portion increases the energy of the incoming water which then flows from the pump into a discharge chamber in the discharge portion. Water exits from the discharge portion as an organized jet providing propulsion for the watercraft.

In conventional jet drive systems, atmospheric pressure is the only force pushing water into the intake portion when the craft is at rest and the eye, or front face of the pump impeller, is above the water level or only partially submerged, thus the net inlet head at the pump inlet is less than atmospheric. Accordingly, at start-up, the pump impeller must first generate a sufficient suction head to draw water from the intake into the pump. This results in a delay or slippage until full water flow through the pump is achieved. In addition, because of initial uneven water flow through the pump, cavitation, which is caused by the formation and collapse of partial vacuums in the flowing water, occurs around the impeller with the consequences of a reduction in water flow thrust as well as damage to the impeller surface.

Prior systems have sought to alleviate these problems by providing marine jet pumps with multiple stages in which a first stage impeller is driven at a slower speed or in counter-rotation to a second and/or subsequent stage impellers. In general, the first stage impeller is larger than the subsequent stage impellers so as to build up water flow through the pump in successive stages of low pressure rise. In addition, such systems house all of the impellers within the pump portion in a manner whereby the first stage impellers are enclosed at their outer perimeter such that water flow is restricted to axial flow through the impeller.

Examples of such prior systems include U.S. Pat. No. 3,328,961, which employs a pump assembly having a larger, slower rotating first stage impeller and a smaller, faster rotating second stage impeller. The impellers are mounted on and driven by separately rotating concentric shafts and are peripherally closely adjacent to the internal surface of the pump housing.

U.S. Pat. No. 3,405,526 describes a multiple stage hydraulic jet propulsion apparatus which combines a slower rotating first stage axial flow impeller and a faster rotating second stage mixed flow impeller. As with the '961 patent, the impellers are mounted on separately rotating concentric shafts within the pump housing so that the peripheral edges of the impeller vanes are closely adjacent to the walls of the housing.

In U.S. Pat. No. 3,531,214 a multistage jet pump is disclosed in which a plurality of successively smaller impellers are radially driven from a common shaft by means of gears on the shaft which mesh with gear teeth on peripheral rings of the impellers. The effect is that the impellers are fully enclosed peripherally by their respective ring gears and, due to the differing gear ratios, are driven at successively higher speeds.

U.S. Pat. No. 5,634,831 discloses a water jet propulsion unit which employs two counter-rotating impellers within the pump. Mounted on concentric, counter-rotating shafts, the impellers are calibrated so that any radial flow created by the upstream impeller is converted into axial flow by the downstream impeller. However, like the other prior art, the impellers of this unit are within the pump housing with their peripheral edges closely adjacent to the housing wall.

Thus, the prior art seeks to solve the problems of delay and cavitation in marine jet drive systems by complex mechanisms. Although these prior art systems may be somewhat effective at improving the efficiency and performance of jet drives once the watercraft powered by them are in motion, the first stage impellers of these systems remain at a position where the eye of the impeller is above the water level or, at best, only partially submerged and the net inlet head is less than atmospheric. Thus, the first stage impeller of the prior art multistage pumps suffers from the same problems that its presence seeks to cure in the subsequent stages.

SUMMARY OF THE INVENTION

The present invention provides a preloader device for marine jet drive pumps which improves start-up and acceleration performance and reduces cavitation using a simple assembly which may be readily incorporated into the production of jet drives or retrofitted to existing units whether of the axial or mixed flow type. The inventor has found that it is not necessary to provide pumps with multiple stage impellers of decreasing size rotating at increasing speeds, or counter-rotating impellers. Rather, improved acceleration and reduced cavitation are obtained by the simple expedient of mounting a preloader device, such as a smaller propeller, impeller or screw type device, on the pump impeller drive shaft ahead of the pump impeller and, preferably, within the intake portion of the marine jet drive, without requiring modification of the pump assembly. This puts the preloader device within the intake portion and in axial alignment directly in front of the eye of the pump impeller. The preloader device increases the net positive suction head available (NPSHA) to the pump impeller in any type of marine jet drive unit thereby raising water within the intake portion and, consequently, pushes water into the pump across the eye of the pump impeller thereby improving initial start-up and acceleration while simultaneously reducing cavitation in the pump impeller under acceleration of the marine jet drive unit. The size and pitch of the preloader device, together with the space between the preloader device and the pump impeller may vary according to the application and needs of the particular marine jet drive unit. Unlike the pump impeller in the marine jet drive unit, the preloader device, since it is of a smaller diameter, is not enclosed at its outer perimeter, but is open; this permits water to not only flow directly into the preloader device, but also around it, thereby providing a more even loading or priming of the pump impeller which improves the performance and acceleration of the drive as well as reducing cavitation in the pump impeller.

The present invention, in one aspect thereof, provides an improvement for a marine jet drive comprising a housing having a forward intake portion, a rearward discharge portion and a pump portion disposed therebetween. The pump portion comprises a housing having an impeller rotationally driven within the housing by a shaft extending through the intake portion. The improvement comprises a preloader device mounted on the shaft forward of the impeller and within the intake portion of the jet drive housing, whereby the preloader is rotationally driven concurrently with and at the same speed as the impeller.

The present invention further provides a device for preloading a marine jet drive pump to reduce cavitation in a jet drive pump impeller; the device including a water propeller mounted on the shaft of the impeller and sized to be rotatable within an intake housing of a marine jet drive unit ahead of and in axial alignment with the eye of the jet drive pump impeller. In operation, the water propeller causes water to be drawn from the intake portion into the pump portion such that the pump impeller is preloaded with water across the eye of the impeller thereby reducing the formation of partial vacuum within the water about the impeller and reducing cavitation.

The present invention further provides a method for preloading water in a marine jet drive pump and reducing cavitation in a jet drive pump impeller, which method comprises providing a water propelling device on a drive shaft of the pump impeller positioned within an intake housing of the marine jet drive ahead of and in axial alignment with the pump impeller, whereby the water propelling device causes water to be drawn from the intake housing into the pump impeller whereby the pump impeller is preloaded with water across the eye of the impeller thereby reducing the formation of partial vacuum within the water about the impeller whereby cavitation is reduced.

The present invention still further provides a method for reducing cavitation within a marine jet drive pump and improving performance of a watercraft propelled by a marine jet drive, which comprises increasing water flow from the intake portion to the jet drive pump impeller when the watercraft is accelerated thereby preloading a marine jet drive pump impeller with water from the intake portion of the marine jet drive.

Thus, it is an object of the invention to provide a preloader device for a marine jet drive pump.

It is a further object of the invention to provide preloader device for a marine jet drive pump in the form of a water propeller mounted on the pump impeller shaft and which rotates at the same speed as the pump impeller.

It is a still further object of the present invention to provide a preloader device for a marine jet drive pump which is located within the intake portion of the marine jet drive in front of the eye of the jet drive pump impeller and which preloads the impeller with water thereby reducing cavitation.

Additional objects and advantages will become evident from the following description and claims.

DETAILED DESCRIPTION OF THE INVENTION

Figure 1:
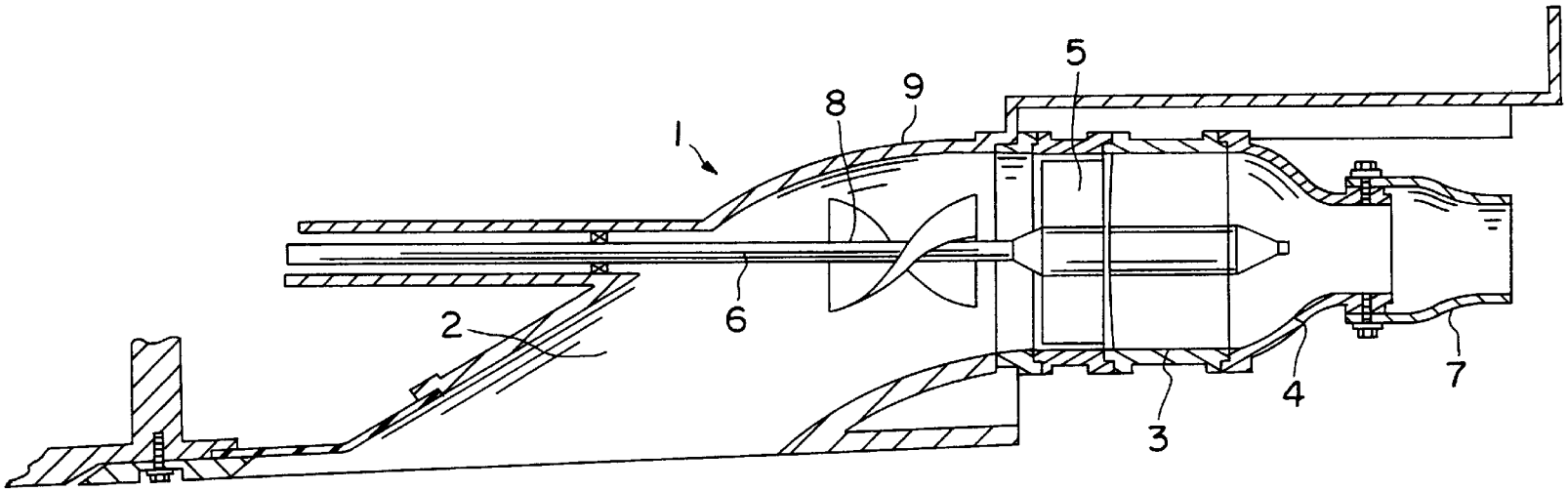
FIG. 1 is a longitudinal sectional view of an axial pump marine jet drive with a simple auger type of preloader device.

As shown in FIG. 1, a marine jet drive unit comprises an intake portion 2, a pump portion 3, and a discharge portion 4. Within the pump portion 3 is an impeller 5 mounted on a drive shaft 6 which extends through the intake portion 2 from a prime mover (not shown). In the operation of the jet drive unit, the shaft 6 rotates to operate the impeller 5 so as to draw water from the intake portion 2 into the pump portion 3 and discharge portion 4 where the water flow exits through a nozzle 7 to provide thrust.

The marine jet drive pump preloader of the present invention is provided to an existing marine jet drive unit by adding to the jet drive a preloader device 8 which has been manufactured or machined to fit the marine jet drive shaft 6 and the water flow intake housing 9. The preloader device 8 may be a multi-bladed propeller, an impeller, an auger or other screw device which is capable of moving water when rotated. For example, FIG. 1 illustrates an axial flow type marine jet drive unit 1 wherein the preloader device 8 is a two bladed auger mounted on the drive shaft 6 within the intake portion 2. As an alternative, a pump impeller of the type used in a personal watercraft, such as a wet-bike or jet-ski, may be used in larger marine jet drive units. Preloader device 8 has a diameter which is smaller than that of the pump impeller 5 such that the periphery of the preloader device 8 is spaced from the walls of the intake housing 9. Because the preloader device 8 is spaced from and not closely adjacent to the walls of the intake housing 9, water can flow around the perimeter of the preloader device 8 as well as axially through it. As an example, a preloader device having a diameter of 5.5 inches has been tested in marine jet drive units such as the Berkeley 12J pumps and pumps of similar size made by other manufacturers. The diameter of the preloader device 8 may vary according to the space constraints of the particular jet drive unit; for example, a significantly smaller preloader device would be used to load and reduce the cavitation in a smaller marine jet drive unit. Furthermore, the diameter of the preloader device may also vary according to the level of the desired load and desired reduction in cavitation. If a pre-existing preloader device, such as a propeller, is used it must be machined to the appropriate diameter to fit within the intake housing and provide the desired preload flow. The pitch and number of blades of the preloader device 8 may vary according to the desired load and desired reduction in cavitation.

Figure 3:
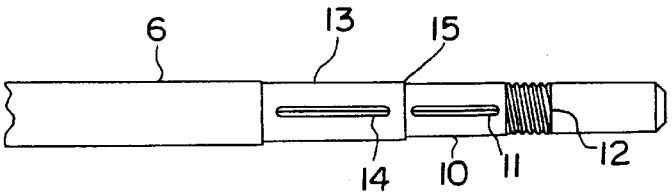
FIG. 3 illustrates a marine jet drive pump shaft modified to accept the preloader device.

Once the desired diameter for the preloader device is achieved, the marine jet drive shaft 6 and the preloader device 8 are machined to accept a key which is installed to fix the preloader device 8 to the shaft 6 so that it will rotate with the pump impeller 5. FIG. 3 illustrates the impeller end of the drive shaft 6 which has been machined to receive the preloader device 8. The machining process is performed such that the preloader device 8 may be placed the desired distance from in front of the eye of the marine jet drive impeller. Thus, for a drive shaft 6 having a first land 10 with a keyway 11 for receiving an impeller 5 and threaded 12 to receive a keeper nut and/or spinner, a second land 13 to receive the preloader device 8 is machined upstream from the first land 10, and a keyway 14 is machined to accept a key to secure the preloader device 8 to the drive shaft 6. The length of the second land 13 and its distance from the shoulder 15 of the first land 10 are determined by the depth of the preloader device 8 and the desired spacing upstream from the impeller 5. A distance of one inch between the preloader device 8 and the marine drive impeller 5 has been found effective, however, the distance between the two elements may vary according to the desired load or the space constraints of the marine jet drive housing. If necessary, a spacer 16 which fits in a snug fashion over the marine jet drive shaft 6 is used to keep the desired distance between the preloader device 8 and the impeller 5. When the machine work is complete, the marine jet drive shaft 6 together with the preloader device 8, the key, the spacer 16 (if needed), and the primary jet drive impeller 5 are installed into the jet drive unit and the nut (not shown) which originally secured the primary jet drive impeller 5 is used to secure the preloader device 8 and spacer 16 on the shaft 6.

Figure 2:
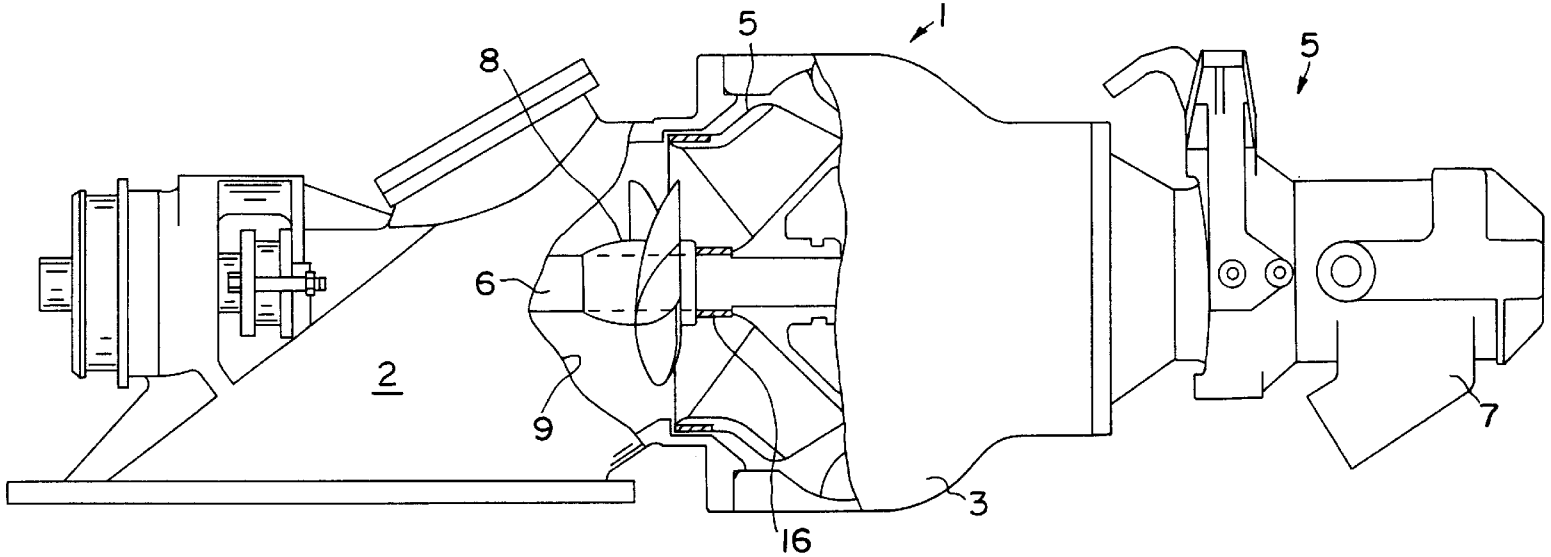
FIG. 2 is a partial cut-away view of a mixed flow marine jet drive pump with a propeller type preloader device.

FIG. 2 illustrates a mixed flow type marine jet drive unit with the preloader device installed as described above. Although a preferred form of the preloader device 8 is shown as a standard 3 bladed propeller, any water propelling means mountable on a rotating shaft may be used, for example, impellers, augers, screws, etc. The number of blades and their pitch are determined by the desired load and the desired cavitation reduction. It is not necessary that the number of blades of the preloader device have any relation to the number of blades or vanes in the impeller 5. Generally, however, from 2 to 5 blades will be used.

Figure 4:
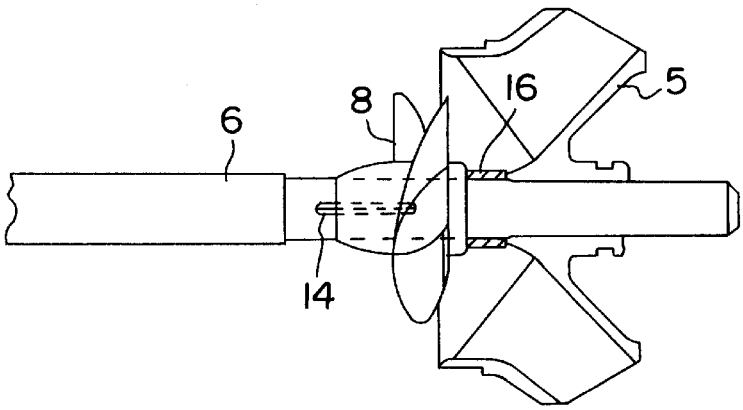
FIG. 4 illustrates a replacement kit for an existing marine jet drive comprising the preloader device premounted on a replacement shaft with a pump impeller.
Figure 5:
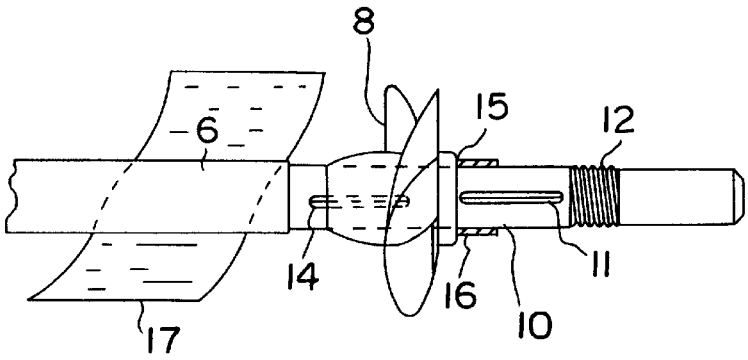
FIG. 5 illustrates a replacement kit for an existing marine jet drive comprising a replacement shaft with the preloader device premounted thereon.
Figure 6:
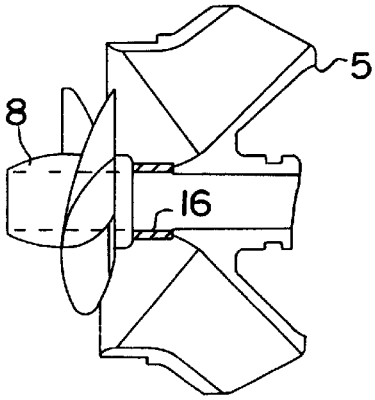
FIG. 6 illustrates a replacement pump impeller for a marine jet drive unit with the preloader device as an integral casting.

In addition to providing the preloader device 8 as a separate item for installation on the drive shaft 6, the preloader device 8, regardless of type, may be cast as an integral part of the marine jet drive shaft 6, as shown in FIG. 5, or with the marine jet drive pump impeller 5, as shown in FIG. 6, instead of being separately manufactured and mounted on a modified shaft 6. Again, the diameter of the preloader device 8 and the distance from the pump impeller 5 is determined using the same criteria, the only difference being that the preloader device is cast with the shaft 6 or the pump impeller 5 and does not require a separate spacer 16. Also, the preloader device 8, shaft 6 and impeller 5 may all be cast together as a unit, as shown in FIG. 4, for installation in new or existing jet drive units.

Finally, the preloader device 8 may be affixed to the marine jet drive impeller 8 by other means, i.e., welding, brazing, shear pins, threading, or other fastening or connection means without casting them as a single element. Again, the diameter constraints and the distance of the preloader device from the jet drive pump impeller must be accommodated and may include the use of a spacer 16 between the preloader device 8 and the impeller 5.

As previously noted, the marine jet drive pump preloader of the present invention may be installed as an integral part of a new jet drive unit during manufacture and assembly. Alternatively, the preloader may be provided as a retrofit comprising the preloader device and a replacement shaft or an integrally cast preloader device/shaft or preloader device/impeller combination as described above for existing jet drive units. Such retrofits may be provided as kits for specific makes and models of jet drive units and may include a replacement impeller 5 which is matched and calibrated to the preloader device 8 for optimum performance. The kits preferably include an instruction set 17 providing the directions for machining an existing pump shaft to receive the preloader device. Alternatively, the kits may include a replacement pump shaft pre-machined to receive the preloader device and the pump impeller.

Adding a preloader device to a marine jet drive unit as described herein results in an increased water flow rate to the pump impeller. For example, flow rates on the order of 4,000 to 6,000 gal/min at 8,000 RPM shaft speed have been obtained. Such flow rates result in improved initial start-up of a so equipped watercraft as well as faster acceleration, for example, speeds in excess of 160 miles per hour in less than 7 seconds. Furthermore, increasing the water flow to the pump impeller and across the eye of the impeller, reduces the formation of pockets of partial vacuum within the water passing through the impeller, thus reducing the incidence of cavitation caused when those pockets collapse.

The marine jet drive cavitation reducer makes the marine jet drive propelled watercraft more functional under acceleration, especially when the acceleration occurs when the marine unit watercraft is operated from a stopped or extremely slow mode. The invention may be used on any watercraft which is propelled by a marine jet drive, including, but not limited to, boats and personal watercraft. The invention will enhance and promote more aggressive "hole shots" for such uses including, but not limited to, pulling water skiers up, drag or river racing, and propelling heavier marine units.

The foregoing description presents the preferred embodiments of the present invention and it is understood that many variations and modifications of those embodiments will be evident to those skilled in the art and may be carried out without departing from the spirit and scope of the present invention.

What is claimed is:

1. In a marine jet drive comprising a housing having a forward intake portion, a rearward discharge portion and a pump portion disposed therebetween, the pump portion containing an impeller rotationally driven by a shaft extending through the intake portion; the improvement comprising a water propelling device mounted on the shaft forward of the impeller and within the intake portion of the jet drive housing, the water propelling device having a diameter which is smaller than the diameter of the impeller, whereby the water propelling device is rotationally driven concurrently with and at the same speed as the impeller causing water to be moved from the intake portion to the impeller whereby the impeller is preloaded with water across the eye of the impeller thereby reducing the formation of partial vacuum within the water about the impeller whereby cavitation is reduced.

2. The marine jet drive of claim 1 wherein the water propelling device is located on the shaft directly in front of the eye of the impeller.

3. The marine jet drive of claim 1 wherein the diameter of the water propelling device is such that the periphery of the water propelling device is spaced from the housing wall of the intake portion whereby water is capable of flowing around the water propelling device.

4. The marine jet drive of claim 3 wherein the water propelling device comprises a multi-bladed propeller.

5. The marine jet drive of claim 3 wherein the water propelling device comprises an auger.

6. The marine jet drive of claim 3 wherein the water propelling device comprises an impeller.

7. A method for preloading water in a marine jet drive pump and reducing cavitation in a jet drive pump impeller comprising providing a water propelling device for mounting on a drive shaft of the marine jet drive pump in a position to be rotatable within an intake housing of a marine jet drive unit ahead of and in axial alignment with the eye of the jet drive pump impeller, whereby water is drawn from the intake housing into the pump thereby preloading the pump with water across the eye of the impeller, thereby reducing the formation of partial vacuum and cavitation within the water about the impeller.

8. The method of claim 7 comprising providing the water propelling device in the form of a multibladed propeller having a smaller diameter than the impeller.

9. The method of claim 7 comprising providing the water propelling device in the form of an auger extending along a portion of the shaft ahead of the impeller and within the intake housing of the marine jet drive.

10. The method of claim 7 comprising providing the water propelling device in the form of an axial impeller having a smaller diameter than the pump impeller.

11. The method of claim 7 comprising providing the water propelling device with a diameter smaller than the impeller of the jet drive pump whereby the periphery of the water propelling device is spaced from the inner surface of the intake housing to permit water flow around the water propelling device.

12. A kit for retrofitting an existing marine jet drive unit with a marine jet drive pump preloader, comprising a water propelling device, at least one spacer, means for securing the water propelling device to a jet drive pump shaft and an instruction set.

13. The kit of claim 12 wherein the instruction set comprises instructions for modifying a jet drive pump shaft from an existing marine jet drive unit.

14. The kit of claim 12 further comprising a replacement jet pump drive shaft having an impeller receiving portion and a preloader receiving portion and adapted to replace an existing jet pump drive shaft in an existing marine jet drive unit and the instruction set comprises instructions for assembling and installing the kit in an existing marine jet drive unit whereby the fluid propelling means is located within the intake housing ahead of the pump impeller.

15. The kit of claim 14 wherein the shaft, water propelling device and spacer are manufactured as a single unit and wherein said single unit is adapted to receive an existing pump impeller from an existing marine jet drive unit for installation within the marine jet drive unit in place of an original pump drive shaft whereby the fluid propelling means is located within the intake housing ahead of the pump impeller.

16. The kit of claim 13 comprising a combination replacement pump impeller for a marine jet drive pump and water propelling device, the water propelling device being attached to the replacement impeller in coaxial alignment therewith and spaced a sufficient distance therefrom whereby installation of the combination replacement impeller and water propelling device on a drive shaft of the jet drive unit locates the water propelling device within the intake housing.

17. A method for reducing cavitation within a marine jet drive pump and improving performance of a watercraft propelled by a marine jet drive, comprising increasing water flow from an intake portion of the marine jet drive to the jet drive pump impeller when the watercraft is accelerated, thereby preloading a marine jet drive pump impeller with water from the intake portion of the marine jet drive.

18. The method of claim 17 wherein water flow is increased to a rate of about 6,000 gal/min.

19. The method of claim 17 further comprising directing increased water flow to the eye of the pump impeller.

20. The method of claim 19 comprising providing a water propelling device within the intake portion of the marine jet drive, the device being rotationally driven in combination and simultaneously with the pump impeller.

* * * * *